US007635169B2

(12) United States Patent
Boucherie

(10) Patent No.: US 7,635,169 B2
(45) Date of Patent: Dec. 22, 2009

(54) TUFT PICKER DEVICE FOR A BRUSH MAKING MACHINE

(75) Inventor: Bart Gerard Boucherie, Izegem (BE)

(73) Assignee: Firma G.B. Boucherie, N.V., Izegem (BE)

( * ) Notice: Subject to any disclaimer, the term of this patent is extended or adjusted under 35 U.S.C. 154(b) by 655 days.

(21) Appl. No.: 11/255,302

(22) Filed: Oct. 21, 2005

(65) Prior Publication Data

US 2006/0087170 A1 Apr. 27, 2006

(30) Foreign Application Priority Data

Oct. 22, 2004 (DE) ..... 20 2004 016 409 U

(51) Int. Cl.
*A46D 1/08* (2006.01)

(52) U.S. Cl. ..... 300/7; 300/2

(58) Field of Classification Search ..... 300/2, 300/5, 7, 9, 21

See application file for complete search history.

(56) References Cited

U.S. PATENT DOCUMENTS 521,630 A * 6/1894 Besson ..... 300/7
800,668 A * 10/1905 Nielson ..... 300/7
1,641,686 A * 9/1927 Nilsson ..... 300/7
1,664,424 A * 4/1928 Jobst ..... 300/7
2,105,334 A * 1/1938 Scully et al. ..... 300/2
2,349,532 A * 5/1944 West ..... 300/7
2,621,079 A * 12/1952 Carlson ..... 300/7
3,072,440 A * 1/1963 Norris ..... 300/2
6,290,303 B1 * 9/2001 Boucherie ..... 300/5

* cited by examiner

*Primary Examiner*—Gary K Graham
(74) *Attorney, Agent, or Firm*—Stuart J. Friedman

(57) ABSTRACT

A tuft picker device for a brush making machine has a bristle magazine for holding a supply of loose bristles, a tuft picker having a tuft picking notch being movable past an open side of the bristle magazine in a working stroke. A shield member is adapted to be shifted across the tuft picker notch to change the effective depth thereof. The shield member can be adjusted by an adjusting device in each working stroke in order to vary the effective depth of the tuft picking notch from one working stroke to the next to change the size of a tuft engaged in the notch.

9 Claims, 3 Drawing Sheets

TUFT PICKER DEVICE FOR A BRUSH MAKING MACHINE

The present invention relates to a tuft picker device for a brush making machine.

Tuft pickers serve to remove individual tufts of bristles from a bristle magazine in succession in order to feed them to a brush making machine. The tuft picker essentially is a slider which reciprocates in a sliding motion at an open side of the bristle magazine and has a tuft picking notch in which the bristles forming the tuft will collect during the sliding motion past the bristle magazine. The tuft picker transports each separated tuft of bristles to a processing station, for example a tufting tool, and is then moved back to the bristle magazine for separating the next tuft of bristles. With each working stroke of the tuft picker, a tuft of bristles is separated in this way.

The profile of the tuft picking notch dictates the quantity of the bristles that are separated in each working stroke of the tuft picker. In order that a single tuft picker device can be used for separating tufts having different quantities of bristles, the effective depth of the tuft picking notch can be varied by laterally covering part of the profile with a shield member. Rather than the bottom of the tuft picking notch, it is then the shield member that defines the depth up to which the bristles can penetrate into this notch. A tuft picker device including a tuft picking notch having an adjustable effective depth is disclosed, e.g., in DE 40 40 297 C2. A device of this type is suitable for separating bristle tufts of different cross-sections for different brushes.

In connection with modern brushes, in particular toothbrushes, it has been desirable to have bristle tufts of different cross-sectional shapes and sizes that are arranged next to each other in a bristle field. Brushes of this kind are complicated to produce since the high-speed, efficiently operating brush making machines available can not be used for making them.

The invention provides a tuft picker device that is capable of varying the effective depth of the tuft picking notch in each working stroke while keeping abreast of modern high-speed brush making machines. The tuft picker device according to the invention for a brush making machine has a bristle magazine for holding a supply of loose bristles, a tuft picker having a tuft picking notch being movable past an open side of the bristle magazine in a working stroke. At least one shield member is adapted to be shifted across the profile of the tuft picking notch to thereby change the effective depth thereof. The shield member is displaced by way of a constrained guidance using an adjusting device. Adjusting devices are available which can perform the required small adjusting stroke rapidly, precisely and reproducibly. An important factor here is a rigid coupling between the shield member and the adjusting device. It has proved to be of advantage to use a crank drive including a rotary drive that is fixed to the machine frame and has a servomotor and including a crank arm articulatedly coupled to a connecting rod which in turn is articulatedly coupled to a stirrup that is adapted to be shifted in translation on the machine frame and by means of which the adjusting stroke is rigidly transmitted to the shield member.

The tuft picker may be curved along a circular arc and be adapted to be pivoted about a fixed axis in a conventional fashion; the shield member then is a rigid rail which is curved in the shape of a circular arc and is engaged by the adjusting device. Alternatively, the adjusting device engages a curved rigid guide which is radially displaceable in relation to the axis and has a cam follower guided in a constrained fashion therein which actuates the shield member.

In another embodiment, the tuft picker is displaceable along a straight path; in this embodiment, a stirrup is then rigidly connected to the shield member which is designed as a straight rigid rail.

Further features and advantages of the invention will be apparent from the following description of several embodiments with reference to the accompanying drawings in which.

Figure 1:
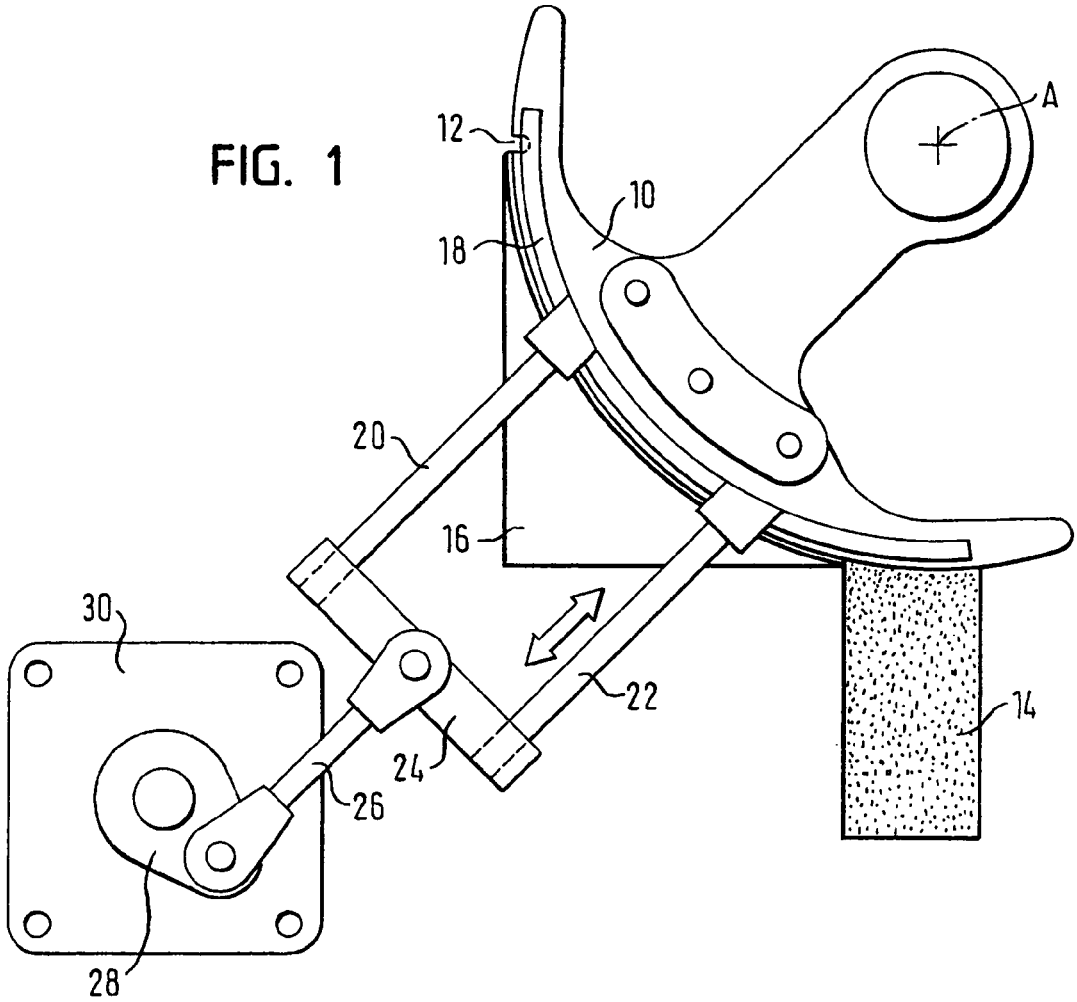
FIG. 1 shows a diagrammatic top view of a tuft picker device having an actuating drive for controlling a shield rail which has the shape of a circular arc and is used for varying the effective depth of a tuft picking notch in a tuft picker.

The embodiment of the tuft picker device as shown in FIG. 1 has a tuft picker 10 that is curved in the shape of a circular arc and can be pivoted about an axis A which is fixed in relation to the machine frame of a brush making machine. The tuft picker 10 has in its peripheral surface a tuft picking notch 12, which is illustrated greatly enlarged in FIG. 2. The peripheral surface of the tuft picker 10 is in contact with an open side of a bristle magazine 14 which has parallel bristles, cut to length, loosely held therein. The tuft picker 10 can be pivoted about the axis A by in working stroke in which the tuft picking notch 12 is moved over the open side of the bristle magazine 14 so that the tuft picking notch fills with bristles from the bristle magazine 14. During the return movement of the tuft picker 10, the bristles that have been removed are held in place in the notch 12 by a screen 16 which is in contact with the periphery of the tuft picker 10. FIG. 1 shows the tuft picker 10 in a delivery position in which the separated tuft of bristles is transferred from the notch 12 to a workstation of a brush making machine.

Figure 2:
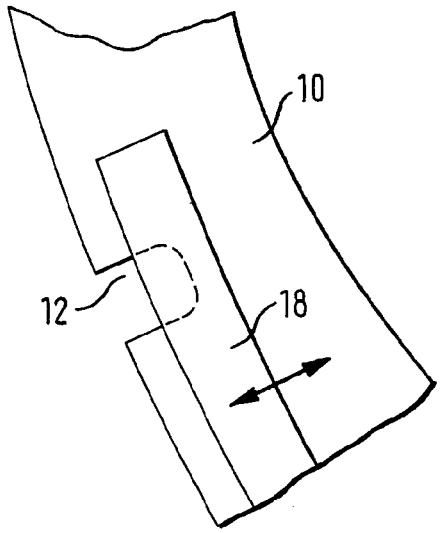
FIG. 2 shows a view of a detail from FIG. 1 on an enlarged scale.

For varying the effective depth of the tuft picking notch 12, a shield or covering member in the form of a rigid rail 18 is provided which is curved in the shape of a circular arc. The rail 18 is connected to a rigid stirrup which consists of a pair of parallel bars 20, 22 and a web 24 connecting them. The stirrup, and the rail 18 along with it, are articulatedly connected via the web 24 to a connecting rod 26 which in turn is articulatedly connected to a crank arm 28 of a rotary drive 30. The rotary drive 30 is mounted on the machine frame of the brush making machine. As indicated by a double arrow in FIG. 1, the bars 20, 22 of the rigid stirrup are mounted to be displaceable in the radial direction in relation to the axis A. Together with the crank drive made up of the crank arm 28 and the connecting rod 26, the rotary drive 30 forms an actuating drive for moving the rail 18 via the rigid stirrup which is formed by the bars 20, 22 and the web 24. This actuating drive, the rotary drive of which is preferably constituted by a servomotor, is capable of displacing the rigid rail 18 in relation to the tuft picker 10, as indicated by a double arrow in FIG. 2, and of doing so very rapidly, very precisely and in a well reproducible manner. This displacement causes the rail 18 to slide transversely across the profile of the tuft picking notch 12 in order to change the effective depth thereof. FIG. 2 shows the rail 18 in a middle position, in which the overall depth of the notch 12 is approximately reduced by half.

Figure 3:
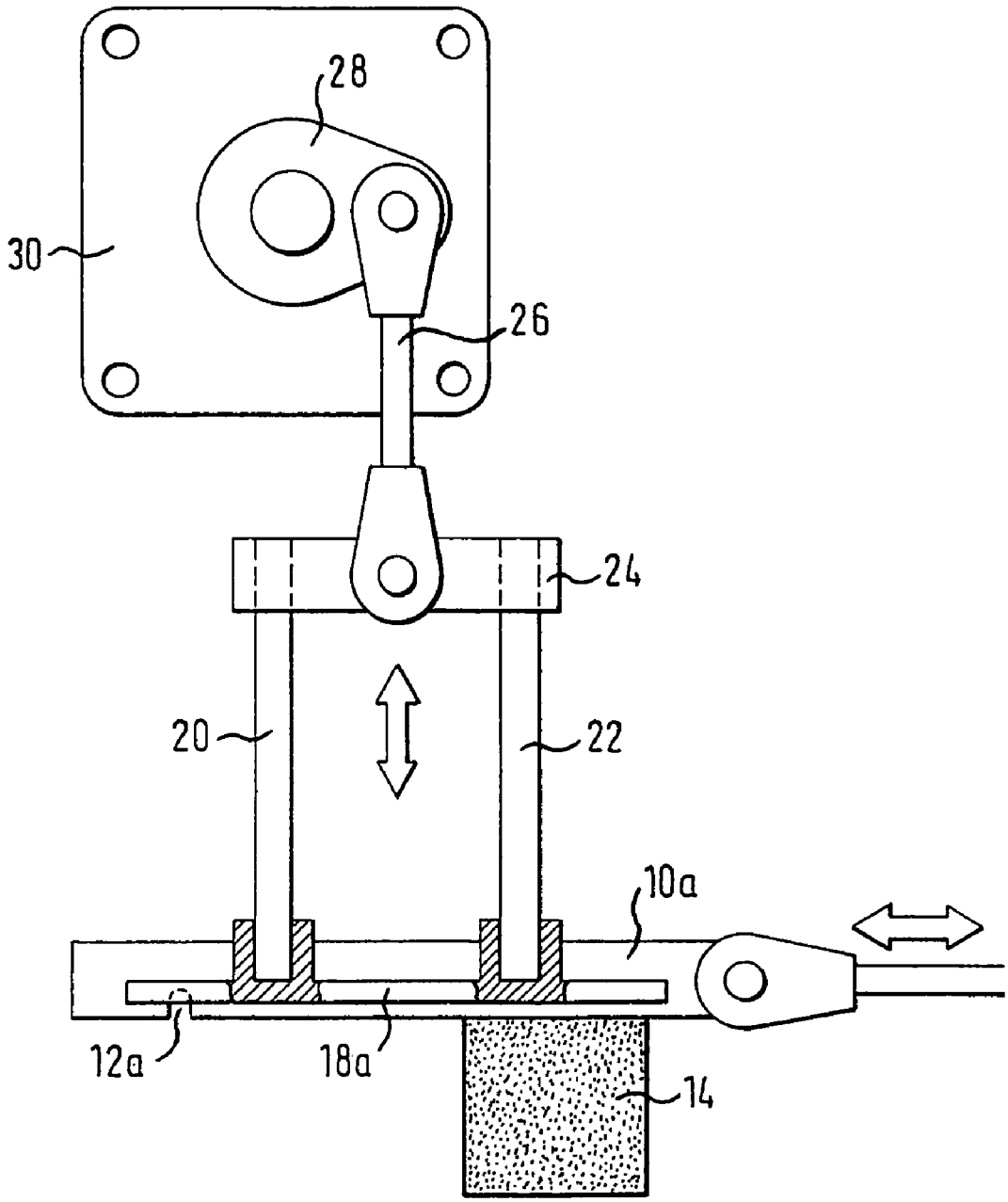
FIG. 3 shows a top view of a second embodiment of the tuft picker device.

FIG. 3 shows an embodiment of the tuft picker device in which a tuft picker 10*a* that can be displaced in a straight line cooperates with a correspondingly straight shield rail 18*a*. All other components are configured in the same way as in the embodiment according to FIG. 1 and are therefore designated by the same reference numerals. The movement of the shield rail 18*a* perpendicular to the direction of displacement of the tuft picker 10*a*, as indicated by a double arrow in FIG. 3, is brought about here by using the rigid stirrup formed by the bars 20, 22 and the web 24.

Figure 4:
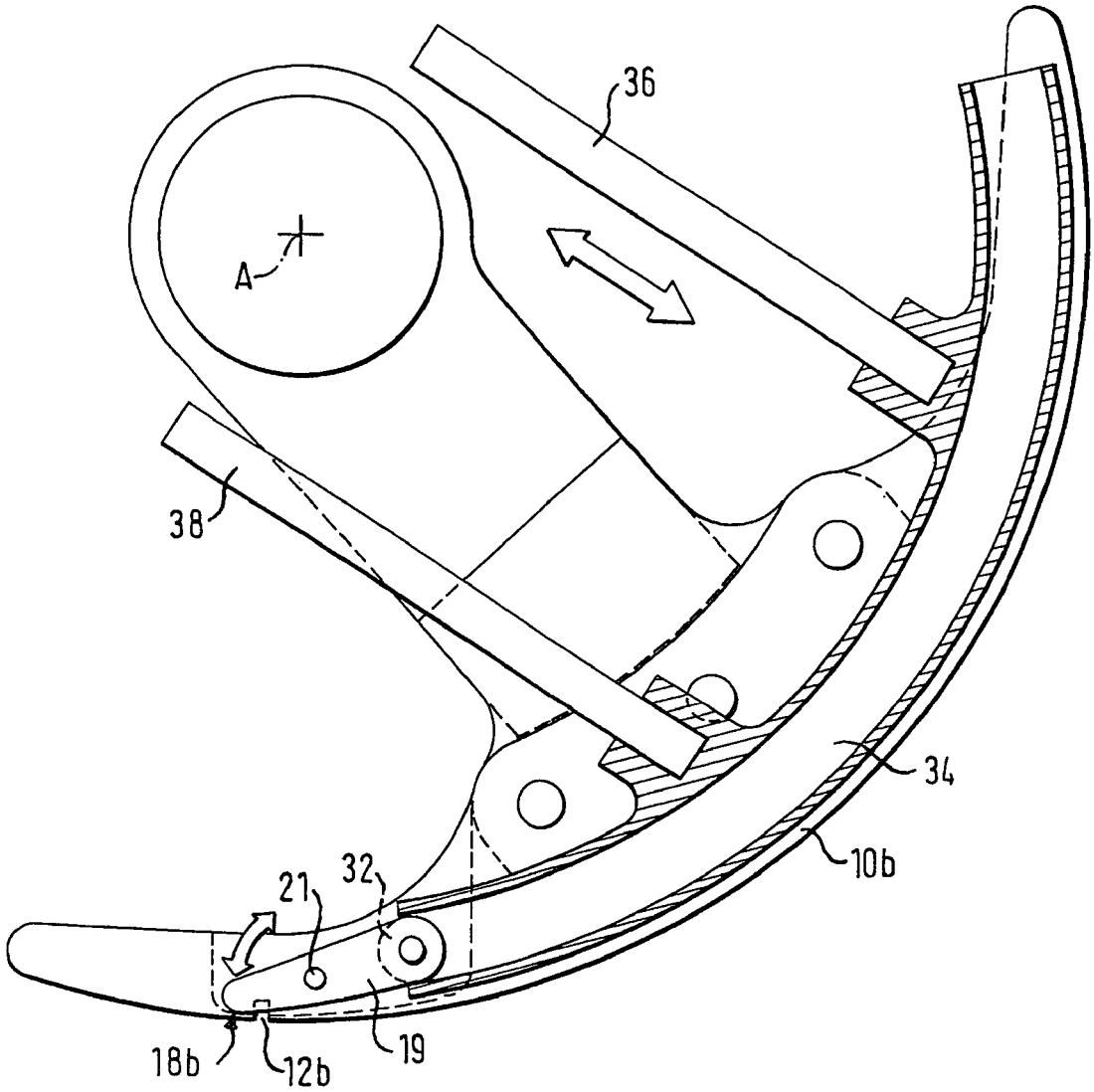
FIG. 4 shows a third embodiment of the tuft picker device.

In the tuft picker device according to FIG. 4, the tuft picker 10*b* cooperates with a shield member 18*b* that is formed by one end of a two-armed lever 19 which is mounted at the tuft picker 10*b* for pivoting about a pin 21. The opposite end of the two-armed lever 19 carries a cam follower in the form of a roller 32. The roller 32 is guided in a guide 34 which is curved so as to correspond to the shape of the tuft picker 10*b* and is mounted on the machine frame so as to be radially displaceable in relation to the axis A of the tuft picker 10*b*. The guide 34 is coupled to an actuating drive by means of rigid bars 36, 38; the actuating drive may be implemented in the same way as in the embodiments described above. As the tuft picker 10*b* performs a pivoting movement, the roller 32 is guided in a constrained fashion in the guide 34. The radius to which the guide 34 is set in relation to the axis A dictates the pivoting position of the two-armed lever 19. The pivoting position of the two-armed lever 19 in turn determines the level of the shield member 18*b* relative to the bottom of the profile of the tuft picking notch 12*b*. Since the radial adjustment of the guide 34 causes a change in the pivoting position of the lever 19 and thus in the position of the shield member 18*b*, as a result the effective depth of the tuft picking notch 12*b* can be varied.

The invention claimed is:

1. A tuft picker device for a brush making machine, comprising a bristle magazine for holding a supply of loose bristles in a mutually parallel condition, a tuft picker having a tuft picking notch and being movable in a working stroke to move the tuft picking notch past an open side of said bristle magazine, at least one shield member which is adapted to be shifted across the tuft picking notch to vary the effective depth of said notch, and an actuating drive coupled to the shield member and adapted to adjust the shield member in each working stroke so as to vary the effective depth of the tuft picking notch from one working stroke to the next thereby varying the size of a tuft engaged in the tuft picking notch, said actuating drive including a crank drive and said crank drive including a rotary drive with a servomotor and a crank arm articulatedly coupled to a connecting rod which in turn is articulatedly coupled to a stirrup that is movable in translation and by means of which an adjusting stroke is rigidly transmitted to the shield member.

2. The tuft picking device according to claim 1, wherein the tuft picker is curved along a circular arc and is adapted to be pivoted about a fixed axis, and the shield member is a rigid rail curved along a circular arc parallel to the tuft picker.

3. The tuft picking device according to claim 2, wherein the stirrup is rigidly connected to the curved rail.

4. The tuft picking device according to claim 1 wherein the tuft picker is displaceable along a straight path.

5. The tuft picking device according to claim 4, wherein a stirrup rigidly connects the shield member to a crank drive, the shield member being a straight rigid rail.

6. A tuft picker device for a brush making machine, comprising a bristle magazine for holding a supply of loose bristles in a mutually parallel condition, a tuft Dicker having a tuft picking notch and being movable in a working stroke to move the tuft picking notch past an open side of said bristle magazine, at least one shield member which is adapted to be shifted across the tuft picking notch to vary the effective depth of said notch, and an actuating drive coupled to the shield member and adapted to adjust the shield member in each working stroke so as to vary the effective depth of the tuft picking notch from one working stroke to the next thereby varying the size of a tuft engaged in the tuft picking notch , wherein the tuft picker is curved along a circular arc and can be pivoted about a fixed axis, and the actuating drive holds a guide curved in parallel to the tuft picker and radially displaceable in relation to the axis, the tuft picker having a cam follower guided in a constrained fashion in the curved guide to actuate the shield member.

7. The tuft picking device according to claim 6, wherein a stirrup rigidly connects the curved guide to a crank drive.

8. The tuft picking device according to claim 6, wherein the cam follower is arranged at a first end of a two-armed lever which is pivotally mounted on the tuft picker, a second end of the lever forming the shield member.

9. The tuft picking device according to claim 8, wherein the cam follower is formed by a roller rotatably mounted on the lever.

* * * * *